US010013956B2

(12) United States Patent
Aimi

(10) Patent No.: US 10,013,956 B2
(45) Date of Patent: Jul. 3, 2018

(54) ENDPIN HOLDER

(71) Applicant: Masami Aimi, Tottori (JP)

(72) Inventor: Masami Aimi, Tottori (JP)

( * ) Notice: Subject to any disclaimer, the term of this patent is extended or adjusted under 35 U.S.C. 154(b) by 0 days.

(21) Appl. No.: 15/554,862

(22) PCT Filed: Sep. 17, 2015

(86) PCT No.: PCT/JP2015/076540
§ 371 (c)(1),
(2) Date: Aug. 31, 2017

(87) PCT Pub. No.: WO2016/139835
PCT Pub. Date: Sep. 9, 2016

(65) Prior Publication Data

US 2018/0047371 A1 Feb. 15, 2018

(30) Foreign Application Priority Data

Mar. 2, 2015 (JP) ..... 2015-040021

(51) Int. Cl.
*G10D 3/00* (2006.01)
*G10G 5/00* (2006.01)

(52) U.S. Cl.
CPC ..... *G10D 3/003* (2013.01); *G10G 5/005* (2013.01)

(58) Field of Classification Search
CPC ..... G10D 3/003
See application file for complete search history.

(56) References Cited

U.S. PATENT DOCUMENTS 2,218,142 A 10/1940 Becker et al.
2,502,229 A 3/1950 Miller
2,814,229 A * 11/1957 Vaccaro ..... G10D 3/003 84/280
2,974,556 A * 3/1961 Fawick ..... G10D 3/003 84/280
3,160,050 A * 12/1964 Klein ..... G10D 3/003 84/280

(Continued)

FOREIGN PATENT DOCUMENTS

GB 178336 A 4/1922
GB 251989 A 9/1926

(Continued)

OTHER PUBLICATIONS

Notification of Transmittal of Translation of the International Preliminary Report on Patentability dated Sep. 14, 2017, in connection with corresponding international application No. PCT/JP2015/076540 (13 pgs.).

(Continued)

*Primary Examiner* — Robert W Horn
(74) *Attorney, Agent, or Firm* — Maier & Maier, PLLC

(57) ABSTRACT

An endpin holder includes a receiving member that has a butting stage against which a tip portion of an endpin with by a cello is butted, and a supporting member that supports the receiving member. The receiving member is rotatably supported by the supporting member. The receiving member is rotatably supported by the supporting member through a bearing. When the cello including the endpin is played, the sound and the acoustic quality can be caused to approach those of the natural resonance of the stringed instrument.

7 Claims, 6 Drawing Sheets

(56) References Cited

U.S. PATENT DOCUMENTS

| | | | | |
|---|---|---|---|---|
| 4,018,129 | A * | 4/1977 | Hollander | G10D 3/003 84/280 |
| 5,003,858 | A * | 4/1991 | Rowell | G10D 3/003 84/280 |
| 5,069,102 | A * | 12/1991 | Wolf | G10D 3/00 248/188.9 |
| 5,297,771 | A * | 3/1994 | Gilbert | G10D 3/003 248/443 |
| 5,920,020 | A * | 7/1999 | Korupp | G10D 3/003 84/410 |
| 6,696,626 | B1 * | 2/2004 | Pagenkopf | G10D 3/003 84/280 |
| 7,084,337 | B1 * | 8/2006 | Schroeder | G10D 1/02 84/274 |
| 7,342,160 | B2 * | 3/2008 | Alberti | G10D 3/003 84/280 |
| 8,735,702 | B1 * | 5/2014 | Miles | A61F 2/013 84/327 |
| 9,858,903 | B2 * | 1/2018 | DeVuono | G10D 3/003 |
| 2007/0113719 | A1 * | 5/2007 | Hsu | G10D 3/003 84/291 |
| 2018/0047371 | A1 * | 2/2018 | Aimi | G10D 3/003 |

FOREIGN PATENT DOCUMENTS

| | | |
|---|---|---|
| JP | 6-25891 | 4/1994 |
| JP | 2007139876 A | 6/2007 |
| JP | 3153830 U | 9/2009 |

OTHER PUBLICATIONS

Notification of Transmittal of the Internatinal Search Report and written Opinion of the International Searching Authority dated Sep. 17, 2015, in connection with corresponding International Application No. PCT/JP2015/076540, 3 pages.

* cited by examiner

ENDPIN HOLDER

TECHNICAL FIELD

The invention relates to an endpin holder and, more particularly, to an endpin holder against which a tip portion of an endpin included in a cello is butted.

BACKGROUND ART

Conventionally, a stringed instrument including an endpin such as a cello or a contrabass is fixed by causing a tip portion of the endpin to directly butt against the floor surface when the stringed instrument is played. However, the endpin slips and the stringed instrument cannot be fixed when the material quality of the floor surface is hard. On the contrary, the point against which the endpin is butted may be recessed or damaged when the material quality of the floor surface is soft.

As a result, the stringed instrument is generally fixed by causing the tip portion of the endpin to butt against an endpin holder (also referred to as "endpin stopper") placed on the floor surface such that the position of the endpin is fixed relative to the floor surface. The conventional endpin holder has a structure on the premise that the endpin holder tenaciously holds the tip portion of the endpin at a fixation position to propagate the vibrations of the stringed instrument to the floor surface. For example, an endpin holder described in Patent Document 1 (JP 3153830 U) is present as the above endpin holder.

PATENT DOCUMENT

Patent Document 1: JP 3153830 U

SUMMARY OF THE INVENTION

Problems to be Solved by the Invention

A cello in the early days of the development of the stringed instruments in the violin family (referred to as "baroque cello") includes no endpin, and therefore, the player plays the cello sandwiching the body of the cello between the player's legs. In this case, the natural resonance vibrations of the cello tend to be secured because the cello is played in the state where the body of the cello substantially floats in the air.

However, the vibrations of the stringed instrument during the playing propagates to the floor to also vibrate (floor sound) when the tip portion of the endpin is caused to directly butt against the floor surface to be fixed thereon or when the tip portion of the endpin is fixed by using a conventional endpin holder. The natural resonance vibrations of the body of the stringed instrument during the playing is suppressed because the lower end portion of the endpin fixed at the lower portion of the body of the cello is fixed at one point on the floor surface or in the endpin holder. In these cases, when the cello including the endpin is played, the sound and the acoustic quality thereof become different from those of the natural resonance of the stringed instrument.

An object of the invention is directed to solve the problems of the conventional endpin holder and is to provide an endpin holder that can cause the sound and the acoustic quality of the stringed instrument including an endpin to approach to those of the natural resonance of the cello when the cello is played.

Means to be Solved the Problem

In order to solve the problem of the conventional art, an endpin holder according to the invention includes: a receiving member that comprises a butting stage against which a tip portion of an endpin comprised by a cello is butted; and a supporting member that supports the receiving member, wherein the receiving member is rotatably supported by the supporting member.

Effect of the Invention

According to the endpin holder of the invention, because the receiving member is rotatably supported by the supporting member, the propagation of the vibrations (mainly, the vibrations in the rotating direction of the receiving member) of the cello including the endpin to the floor can be suppressed. The cello including the endpin can be held allowing free vibrations of the cello. As a result, when the cello including the endpin is played, the sound and the acoustic quality can be caused to approach to those of the natural resonance of the stringed instrument.

BRIEF DESCRIPTION OF DRAWINGS

These and other objects and features of the invention will be apparent from the following description concerning a preferred embodiments with reference to the accompanying drawings, in which.

DESCRIPTION OF EMBODIMENTS

Figure 1:
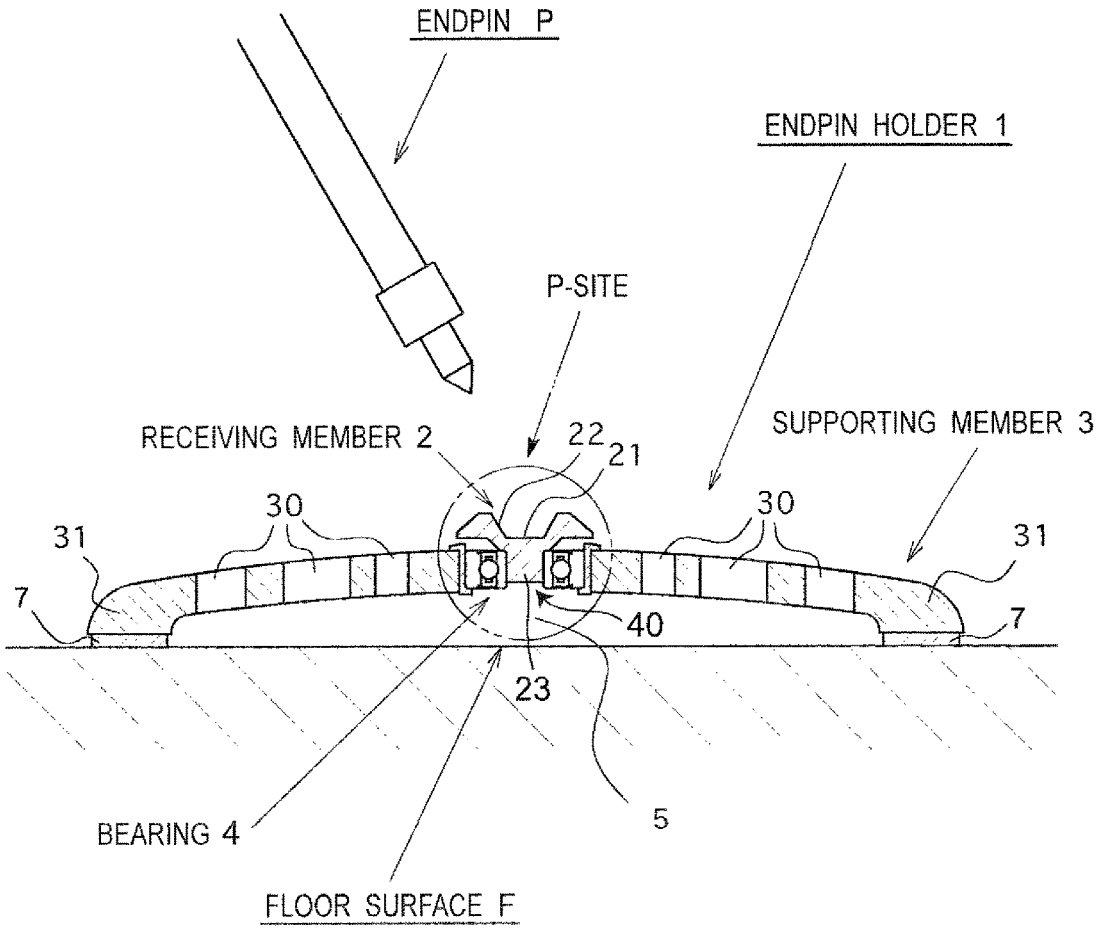
FIG. 1 is a cross-sectional diagram of an endpin holder according to a first embodiment of the invention.

An endpin holder according to the invention includes: a receiving member that comprises a butting stage against which a tip portion of an endpin of a cello is butted; and a supporting member that supports the receiving member, wherein the receiving member is rotatably supported by the supporting member.

According to this configuration, because the receiving member is rotatably supported by the supporting member, the propagation of the vibrations of the cello including the endpin to the floor can be suppressed. The cello including the endpin can be held allowing free vibrations of the cello. As a result, when the cello including the endpin is played, the sound and the acoustic quality can be caused to approach to those of the natural resonance of the stringed instrument.

The receiving member may be rotatably supported by the supporting member through a bearing. According to this configuration, the butting stage of the receiving member can smoothly rotate by the action of the bearing and any propagation of the vibrations of the cello including the endpin to the floor can be suppressed.

The bearing may include an outer ring portion and an inner ring portion, wherein the outer ring portion is fixed to the supporting member, and the inner ring portion is fixed to the receiving member.

The butting stage may be configured to be positioned in a shaft hole surrounded by the inner ring portion of the bearing.

The receiving member may have a rising wall that rises upward, in an outer circumferential portion of the butting stage. According to this configuration, any unintentional departure of the endpin from the butting stage can be suppressed.

The supporting member may have a circumferential portion thereof protruding downward such that a space is formed under the receiving member. According to this configuration, because the receiving member is substantially floated from the floor surface when the endpin holder is placed on the floor surface, any propagation of the vibrations of the cello including the endpin to the floor can further be suppressed. According to this configuration, the supporting member can be elastically deformed using the space and the cello including the endpin can elastically be supported. As a result, any propagation of the vibrations of the cello including the endpin to the floor can further be suppressed.

The supporting member may be formed in a flattened dome shape having a circumferential portion thereof protruding downward such that a space is formed under the receiving member, and wherein the supporting member has plural through holes formed therein that cause the space and an outer face side of the supporting member to communicate with each other. According to this configuration, the supporting member can be caused to more easily be elastically deformed by forming the plural through holes in the supporting member. As a result, any propagation of the vibration of the cello including the endpin to the floor can further be suppressed. Imparting both of the elasticity and the strength to the supporting member is facilitated because the supporting member has a flattened dome shape.

The endpin holder according to the invention may further include a reinforcing plate that is attached to a circumferential portion of the supporting member to reinforce the supporting member.

The endpin holder according to the invention may further include an anti-slip member at a point at which the endpin holder is in contact with a floor surface.

An endpin holder according to each of embodiments of the invention will be described below. The endpin holder according to each of the embodiments includes the receiving member and the supporting member, and has a basic configuration for the receiving member to be rotatably supported by the supporting member.

The following embodiments only absolutely exemplify and describe the invention, and the invention is not limited to the following specific embodiments.

Figure 5:
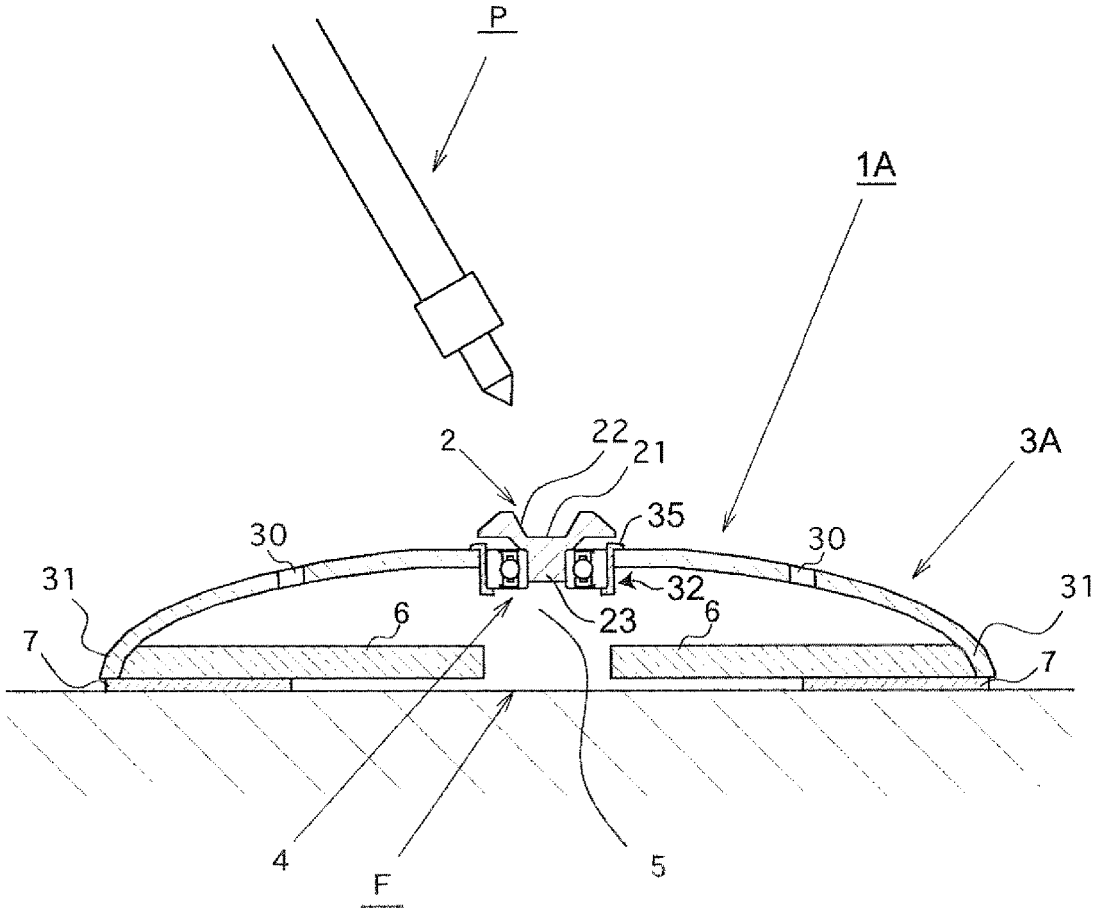
FIG. 5 is a cross-sectional diagram of an endpin holder according to a second embodiment of the invention.
Figure 6:
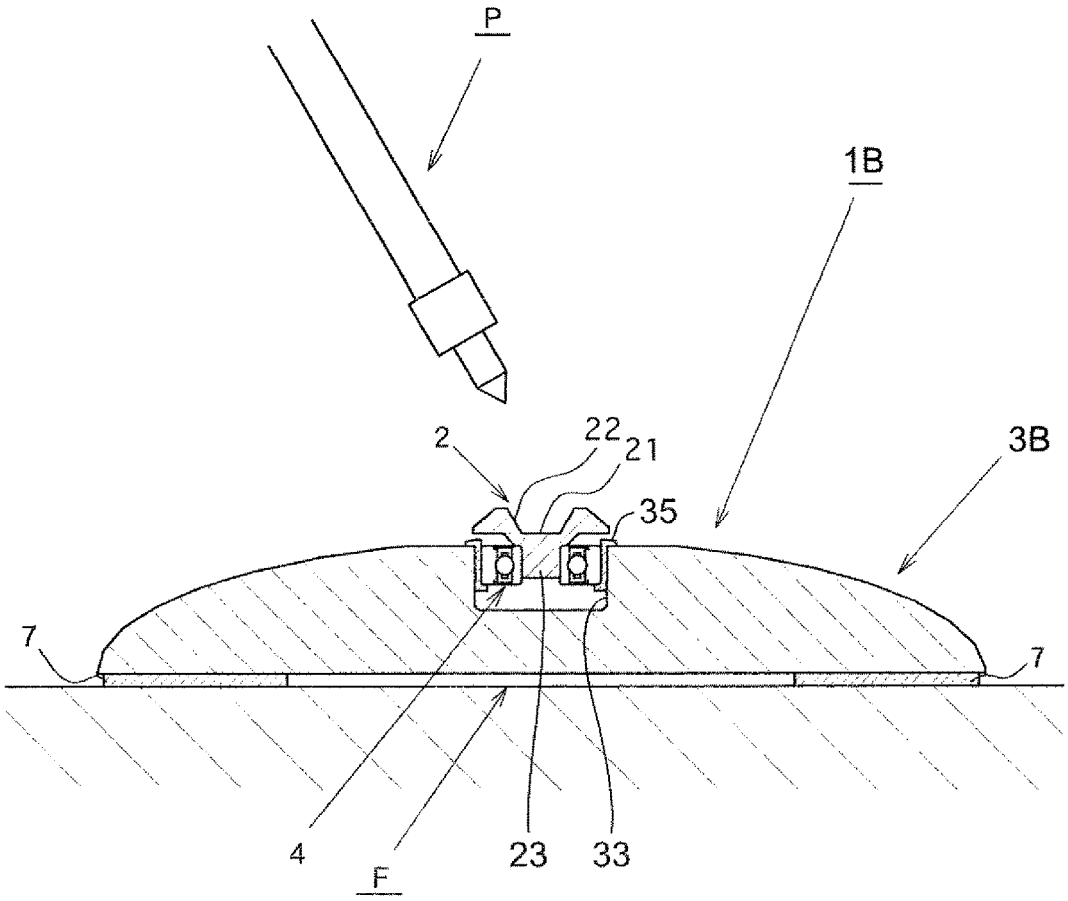
FIG. 6 is a cross-sectional diagram of an endpin holder according to a third embodiment of the invention.

In FIGS. 1, 5, and 6, the endpin and the floor surface are depicted in addition to the endpin holder for the convenience of the description. The hatching for the cross-sectional portions of the bearing is not depicted therein.

(First Embodiment)

Figure 2:
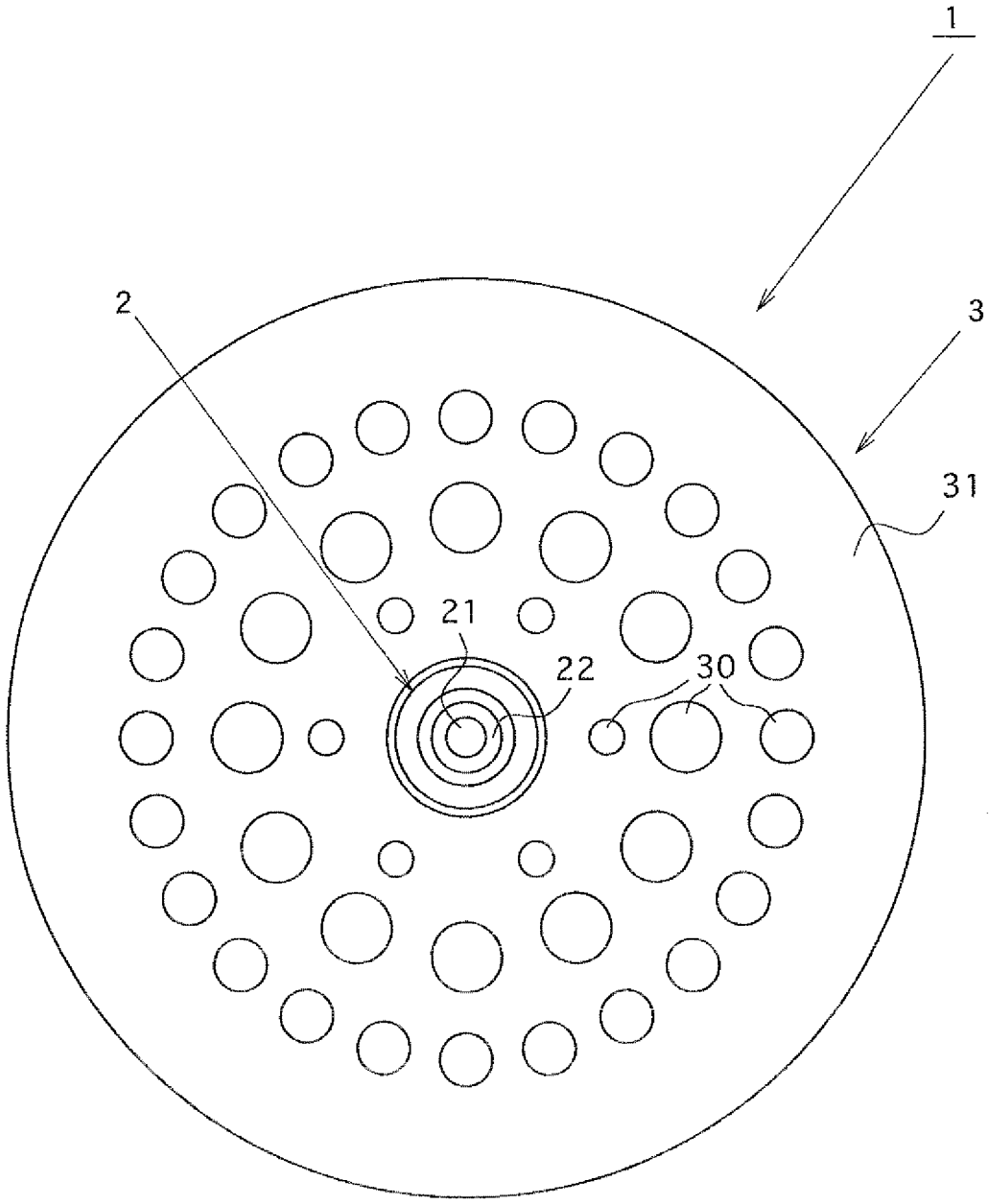
FIG. 2 is a plan diagram of the endpin holder according to the first embodiment of the invention.

An endpin holder 1 according to the first embodiment of the invention will be described with reference to FIGS. 1 to 3.

The endpin holder 1 according to the first embodiment is configured for a receiving member 2 to be rotatably supported on a supporting member 3 through a bearing 4. The supporting member 3 has a configuration for a circumferential portion 31 to protrude downward. Thereby, a space 5 is formed under the receiving member 2.

[Receiving Member]

The receiving member 2 includes a butting stage 21 against which the tip portion of an endpin P is butted. The receiving member 2 is rotatably supported by the supporting member 3 through the bearing 4.

Figure 3:
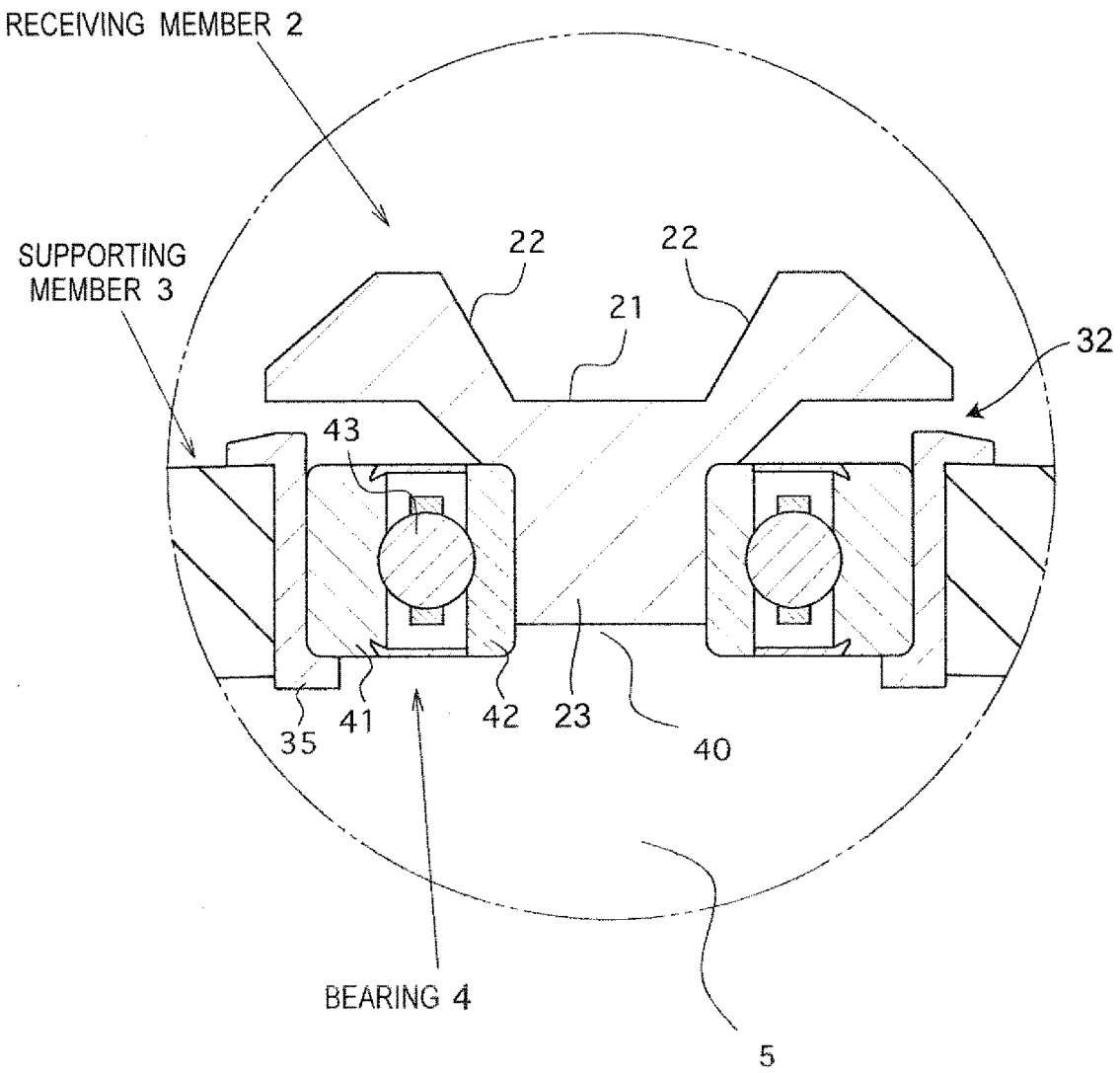
FIG. 3 is a partially enlarged cross-sectional diagram of FIG. 1.

In the first embodiment, as depicted in FIG. 3, the receiving member 2 is fixed to an inner ring portion 42 of the bearing 4. For example, in a lower portion of the receiving member 2, an insertion portion 23 to fit in a shaft hole 40 surrounded by the inner ring portion 42 of the bearing 4 is formed. The receiving member 2 is fixed to the inner ring portion 42 of the bearing 4 by inserting the insertion portion 23 into the shaft hole 40 of the bearing 4 for the insertion portion 23 to fit therein. An outer ring portion 41 of the bearing 4 is fixed to the supporting member 3 through a holder 35.

The butting stage 21 is formed above the insertion portion 23 of the receiving member 2. In the first embodiment, as depicted in FIG. 2, the butting stage 21 is formed in a circular shape in a planar view. The butting stage 21 is formed to have a flat face that is parallel to a floor surface F or a substantially flat face that is substantially parallel to the floor surface F when the endpin holder 1 is put on the floor surface F.

The receiving member 2 includes a rising wall 22 in an outer circumferential portion of the butting stage 21. In the first embodiment, the rising wall 22 is formed to obliquely rise upward and outward in the outer circumferential portion of the butting stage 21.

Figure 4:
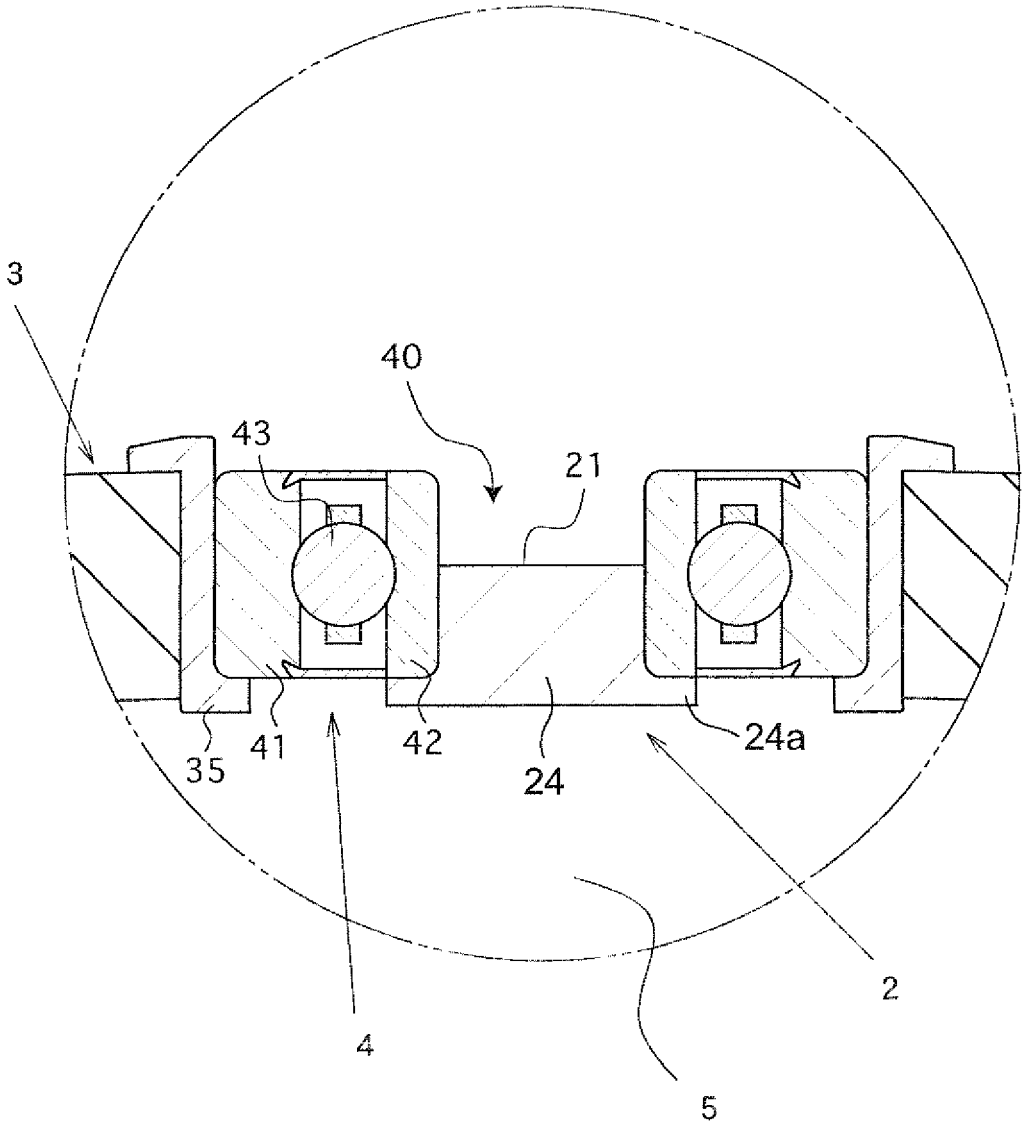
FIG. 4 is a cross-sectional diagram of a modification example of the receiving member.

As depicted in FIG. 4, the receiving member 2 may be configured for the butting stage 21 to be positioned in the shaft hole 40 of the bearing 4. For example, the receiving member 2 may include an insertion portion 24 that has a substantially round-column shape to fit in the shaft hole 40 of the bearing 4, and may be fixed to the inner ring portion 42 of the bearing 4 by inserting the insertion portion 24 into the shaft hole 40 of the bearing 4 for the insertion portion 24 to fit therein.

In a modification example depicted in FIG. 4, the receiving member 2 incudes a flange portion 24*a* in the lower end portion of the insertion portion 24, and is fixed to the inner ring portion 42 of the bearing 4 by inserting the insertion portion 24 into the shaft hole 40 from underneath for the flange portion 24*a* to be in contact with the lower end portion of the inner ring portion 42.

In the modification example depicted in FIG. 4, the upper face of the receiving member 2 (the upper face of the insertion portion 24) constitutes the butting stage 21. The insertion portion 24 has a length (the height) with which the butting stage 21 is positioned in the shaft hole 40 of the bearing 4. The butting stage 21 is formed to have a flat face that is parallel to the floor surface F or a substantially flat face that is substantially parallel to the floor surface F when the endpin holder 1 is put on the floor surface F.

[Supporting Member]

The supporting member 3 is configured to rotatably support the receiving member 2. For example, the supporting member 3 is configured to rotatably support the receiving member 2 through the bearing 4.

In the first embodiment, as depicted in FIG. 3, the outer ring portion 41 of the bearing 4 is fixed to the supporting member 3 by fitting the bearing 4 in a holding hole 32 disposed in the central portion of the supporting member 3, through the holder 35. As depicted in FIG. 1, the bearing 4 is positioned in the central portion of the supporting member 3 in the state where the bearing 4 is placed to be decumbent (the state where the shaft hole 40 is open in the up-down direction).

In the first embodiment, the receiving member 2 can smoothly rotate relative to the supporting member 3 because the receiving member 2 is fixed in the shaft hole 40 of the bearing 4. Thereby, the butting stage 21 included in the receiving member 2 is enabled to freely rotate in a horizontal plane in which the butting stage 21 is fixed to the inner ring portion 42 of the bearing 4. As a result, any propagation of the vibrations in the horizontal direction to the floor can be suppressed when the cello including the endpin P is played.

In the first embodiment, the supporting member 3 has a configuration for the circumferential portion 31 to protrude downward such that the space 5 is formed on the lower side of the point at which the receiving member 2 is positioned. Thereby, the receiving member 2 is substantially floated from the floor surface F when the endpin holder 1 is placed on the floor surface F, and therefore, any propagation of the vibration of the cello including the endpin P can further be suppressed. Preferably, the supporting member 3 is configured to have a flattened dome shape as depicted in FIG. 1 (whose vertical cross-section has a substantially arch shape).

Preferably, a material having relatively high elasticity such as wood, bamboo, or plastic is used as the material quality of the supporting member 3. Thereby, proper elasticity can be imparted to the supporting member 3. The supporting member 3 may be reinforced using a carbon fiber or the like. Preferably, a material having a low specific gravity is used as the material quality of the supporting member 3 for the weight thereof to be low.

The size of the supporting member 3 is, for example, 50 to 160 mm. Preferably, the thickness of the supporting member 3 (the thickness of the ceiling portion) is 2 to 7 mm depending on the material to establish both of the proper elasticity and strength.

The supporting member 3 has plural through holes 30 formed therein that cause the space 5 and the outer face side of the supporting member 3 to communicate with each other. The shape of each of the through holes 30 is, for example, a circular shape or an oval shape. The size of each of the through holes 30 may be different from each other.

The size of the through hole 30 (the diameter of the largest portion thereof) is, for example, equal to or larger than 2 mm. The number of the through holes 30 may only be plural, and may only be the proper number corresponding to the hardness and the thickness of the material of the supporting member 3 from the viewpoint of imparting the proper elasticity.

The plural through holes 30 may be arranged on the substantially same circumference centering the receiving member 2. The plural through holes 30 may be arranged in substantially concentric fashion centering the receiving member 2 as depicted in FIG. 2 or the like.

[Bearing]

In the first embodiment, as above, the bearing 4 is used to rotatably support the receiving member 2 on the supporting member 2. For example, as depicted in FIG. 3, a what-is-called rolling bearing that includes the outer ring portion 41 (an outer race), the inner ring portion 42 (an inner race), and plural rolling elements 43 arranged between the outer ring portion 41 and the inner ring portion 42 can be used as the bearing 4.

Preferably, a relatively small and light-weight bearing is used as the bearing 4. The inner diameter of the bearing 4 (the diameter of the shaft hole 40) is, preferably, 3 to 10 mm and, more preferably, 5 to 8 mm.

[Anti-Slip Member]

An anti-slip member 7 acts to cause the endpin holder 1 to be grippy and is disposed at a point at which the endpin holder 1 is in contact with the floor surface F. In the first embodiment, the anti-slip member 7 is disposed in the circumferential portion 31 of the supporting member 3.

The material quality of the anti-slip member 7 may only achieve an anti-slip effect and, may be a rubber material such as a natural rubber or a synthetic rubber (for example, a silicone rubber or a urethane rubber).

According to the endpin holder 1 of the first embodiment, any propagation of the vibrations of the cello including the endpin P to the floor can be suppressed because the receiving member 2 is rotatably supported by the supporting member 3. The cello including the endpin P can be held allowing the free vibrations of the cello. As a result, when the cello including the endpin P is played, the sound and the acoustic quality thereof can be caused to approach to those of the natural resonance of the stringed instrument.

(Second Embodiment)

An endpin holder 1A according to the second embodiment of the invention will described with reference to FIG. 5.

The endpin holder 1A according to the second embodiment differs from the endpin holder 1 according to the first embodiment in that the endpin holder 1A includes a supporting member 3A instead of the supporting member 3 and further includes a reinforcing plate 6.

The supporting member 3A has a smaller thickness (the thickness of the ceiling portion) than that of the supporting member 3, and is formed in a dome shape that is more flattened than that of the supporting member 3. In the central portion of the supporting member 3A, a holding hole 32 that rotatably holds the receiving member 2 through the holder 35 and the bearing 4 is formed. The number of the through holes 30 disposed in the supporting member 3A is smaller than the number of the through holes 30 disposed in the supporting member 3.

The reinforcing plate 6 reinforces the supporting member 3A and is attached to the circumferential portion 31 of the supporting member 3A. The reinforcing plate 6 is a plate-like member having a ring shape, and is attached to fit in the inner side of the circumferential portion 31 of the supporting member 3A.

In the second embodiment, the anti-slip member 7 is disposed to extend over the lower face of the reinforcing plate 6 and the circumferential portion 31 of the supporting member 3A.

According to the endpin holder 1A of the second embodiment, similarly to the endpin holder 1 of the first embodiment, any propagation of the vibrations of the cello including the endpin P to the floor can be suppressed because the receiving member 2 is rotatably supported by the supporting member 3A. The cello including the endpin P can be held allowing the free vibrations of the cello. As a result, when the cello including the endpin P is played, the sound and the acoustic quality thereof can be caused to approach to those of the natural resonance of the stringed instrument.

According to the endpin holder 1A of the second embodiment, because the supporting member 3A is formed in the flattened dome shape whose circumferential portion protrudes downward, imparting of both of the elasticity and the strength to the supporting member 3A is facilitated. Thereby, the supporting member 3A can have the elasticity equal to that of the supporting member 3 even when the number of the through holes 30 disposed in the supporting member 3A is reduced to be smaller than the number of the through holes 30 disposed in the supporting member 3.

(Third Embodiment)

An endpin holder 1B according to the third embodiment of the invention will be described with reference to FIG. 6.

The endpin holder 1B according to the third embodiment differs from the endpin holder 1 according to the first embodiment in that the endpin holder 1B includes a supporting member 3B instead of the supporting member 3.

The supporting member 3B has a solid structure whose outer shape is a flattened dome shape. In the central portion of the upper face of the supporting member 3B, a recess 33 to rotatably accommodate the receiving member 2 through the holder 35 and the bearing 4 is formed.

According to the endpin holder 1B of the third embodiment, similarly to the endpin holder 1 according to the first embodiment, any propagation of the vibrations of the cello including the endpin P to the floor can be suppressed because the receiving member 2 is rotatably supported by the supporting member 3B. The cello including the endpin P can be held allowing the free vibrations of the cello. As a result, when the cello including the endpin P is played, the sound and the acoustic quality thereof can be caused to approach to those of the natural resonance of the stringed instrument.

(Use Method for Endpin Holder)

Each of these endpin holders 1, 1A, and 1B is used by, for example, being disposed for the tip portion of the endpin P included in the cello to butt against the butting stage 21 in the state where the endpin holder is put on the floor surface F.

Though the tone color, the resonance, and the playability of a stringed instrument are extremely sensitive and delicate, the sound and the acoustic quality can be caused to approach to those of the natural resonance of a cello when the stringed instrument is played using any one of the endpin holders 1, 1A, and 1B. For the player thereof, it can be expected that the responsiveness (sound generation) of the cello is also improved.

Combining arbitrary embodiments of the above various embodiments to each other enables achievement of the effects of the combined embodiments.

INDUSTRIAL APPLICABILITY

The endpin holder according to the invention can cause the sound and the acoustic quality to approach to those of the natural resonance of a cello including an endpin when the stringed instrument is played, and is therefore also useful for a stringed instrument including an endpin such as a contrabass.

The invention has been described with reference to specific embodiments while the invention is not limited to the embodiments, and those skilled in the art can make various changes and modifications thereto without departing from the scope of the claims appended hereto.

The disclosed contents of the specification, the drawings, and the claims of JP 2015-40021 filed on Mar. 2, 2015 are incorporated herein for their entirety by reference.

EXPLANATIONS OF LETTERS OR NUMBERS

1, 1A, 1B endpin holder
2 receiving member
21 butting stage
22 rising wall
23, 24 insertion portion
24*a* flange portion
3, 3A, 3B supporting member
30 through hole
31 circumferential portion
32 holding hole
33 recess
34 holder
4 bearing
40 shaft hole
41 outer ring portion
42 inner ring portion
43 rolling element
5 space
6 reinforcing plate
7 anti-slip member
P endpin
F floor surface

The invention claimed is:

1. An endpin holder comprising:

a receiving member that has a butting stage against which a tip portion of an endpin comprised by a cello is butted; and a supporting member that supports the receiving member, wherein the receiving member is rotatably supported by the supporting member through a bearing, the supporting member is formed in a flattened dome shape having a circumferential portion thereof protruding downward such that a space is formed under the receiving member, and the supporting member has plural through holes formed therein that cause the space and an outer face side of the supporting member to communicate with each other.

2. The endpin holder according to claim 1, wherein the bearing further comprises:

an outer ring portion; and an inner portion, wherein the outer ring portion is fixed to the supporting member, and the inner ring portion is fixed to the receiving member.

3. The endpin holder according to claim 2, wherein the butting stage is configured to be positioned in a shaft hole surrounded by the inner ring portion of the bearing.

4. The endpin holder according to claim 1, wherein the receiving member has a rising wall that rises upward, in an outer circumferential portion of the butting stage.

5. The endpin holder according to claim 1, wherein the supporting member has a circumferential portion thereof protruding downward such that a space is formed under the receiving member.

6. The endpin holder according to claim 1, further comprising:

a reinforcing plate that is attached to a circumferential portion of the supporting member to reinforce the supporting member.

7. The endpin holder according to claim 1, further comprising:

an anti-slip member at a point at which the endpin holder is in contact with a floor surface.

* * * * *